US007382863B2

(12) United States Patent
Parampil et al.

(10) Patent No.: US 7,382,863 B2
(45) Date of Patent: Jun. 3, 2008

(54) ANODE COOLING SYSTEM FOR AN X-RAY TUBE

(75) Inventors: George Parampil, Bangalore (IN); Arunvel Thangamani, Tirunelveli (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/262,662

(22) Filed: Oct. 31, 2005

(65) Prior Publication Data

US 2007/0098143 A1 May 3, 2007

(51) Int. Cl.
*H01J 35/10* (2006.01)

(52) U.S. Cl. ..... 378/141; 378/130

(58) Field of Classification Search ..... 378/130, 378/133, 141, 125, 119, 121
See application file for complete search history.

(56) References Cited

U.S. PATENT DOCUMENTS 4,625,324 A * 11/1986 Blaskis et al. ..... 378/130
5,506,881 A * 4/1996 Ono et al. ..... 378/125
5,579,364 A * 11/1996 Osaka et al. ..... 378/130
2002/0085676 A1* 7/2002 Snyder ..... 378/130
2002/0146092 A1* 10/2002 Richardson et al. ..... 378/130
2003/0174811 A1* 9/2003 Lu et al. ..... 378/121

* cited by examiner

*Primary Examiner*—Hoon Song
(74) *Attorney, Agent, or Firm*—Peter Vogel, Esq.; Ellis Ramirez, Esq.

(57) ABSTRACT

In some embodiments, an anode cooling system for a rotating-anode type X-ray tube includes a heat pipe arrangement comprising an evaporator part coupled to an anode, a condenser part coupled to a bearing of the anode, and a plurality of heat pipes arranged in mutually opposing configuration, in-between the evaporator part and the condenser part, wherein the resultant dynamic force on the heat pipes is substantially zero. In some embodiments, an anode cooling system for an X-ray tube, comprises a first heat pipe configured for operating at a predetermined high first temperature range near an anode, a second heat pipe configured for operating at a predetermined low second temperature range coupled to the first heat pipe, and a heat sink coupled to the second heat pipe, and a liquid metal filled in-between the heat pipes and the anode to transfer heat from the anode to the heat pipe by convection.

19 Claims, 4 Drawing Sheets

200

400

ANODE COOLING SYSTEM FOR AN X-RAY TUBE

FIELD OF THE INVENTION

This invention relates generally to cooling systems, and more particularly to, a target cooling system for a rotating anode in an X-ray tube.

BACKGROUND OF THE INVENTION

Generally, in a rotating-anode type X-ray tube that operates at an average load of about 3 KW or more, the target temperature, bearing temperature and the rotational speed of the anode tend to increase beyond safe limits. A typical application of the X-ray tube at such operating load includes generation of X-rays in medical imaging. At a peak power of about 80 kW, the focal spot temperature of the anode is likely to increase to about 3000 deg C., which may cause target melt and bearing failure in an X-ray tube operation. Therefore, for a safe and failure-free operation of the X-ray tube, an efficient cooling system for the anode becomes necessary.

Known systems for cooling the anode in a rotating-anode type X-ray tube includes providing a means for facilitating heat transfer from the anode to a location away from anode especially via, individual or combined conduction, convection and radiation.

Typically, a means for transferring the heat from the anode to a location away from the anode includes a heat pipe mechanism coupled to the anode. However, these known heat pipe mechanisms suffer from problems associated with poor thermal efficiency, poor rotation balance of anode and environmental and health and safety issues.

Thus, there exists a need for an anode cooling system for an X-ray tube, wherein the cooling system (i) provides for excellent thermal efficiency, (ii) does not create dynamic imbalance in the rotating anode, (ii) provides improved bearing life (iv) provides a substantially noise-free operation, (iv) poses no issues in terms of environment, health and safety.

SUMMARY OF THE INVENTION

The above-mentioned shortcomings, disadvantages and problems are addressed herein which will be understood by reading and understanding the following specification.

In one embodiment, an anode cooling system for a rotating-anode type X-ray tube includes a heat pipe arrangement comprising an evaporator part and a condenser part, the evaporator part coupled to the target of an anode, the condenser part coupled to a bearing of the anode, and a plurality of heat pipes configured in-between the evaporator part and the condenser part, wherein the heat pipes are arranged in mutually opposing configuration, such that the resultant dynamic force on the heat pipes is substantially zero.

In another embodiment, an anode cooling system for an X-ray tube, comprises a first heat pipe configured for operating at a predetermined high first temperature range near an anode target and receives heat from the anode by radiation, a second heat pipe configured for operating at a predetermined low second temperature range coupled to the first heat pipe, and a heat sink coupled to the second heat pipe.

In another embodiment, an anode cooling system for an X-ray tube, comprises a first heat pipe configured for operating at a predetermined high first temperature range near an anode, a second heat pipe configured for operating at a predetermined low second temperature range coupled to the first heat pipe, a heat sink coupled to the second heat pipe.

Apparatus and systems of varying scope are described herein. In addition to the aspects and advantages described in this summary, further aspects and advantages will become apparent by reference to the drawings and by reading the detailed description that follows.

DETAILED DESCRIPTION OF THE INVENTION

In the following description, reference is made to the accompanying drawings that form a part hereof, and in which is shown by way of illustration, specific embodiments which may be practiced. These embodiments are described in sufficient detail to enable those skilled in the art to practice the embodiments, and it is to be understood that embodiments may be utilized and that it will be appreciated that logical, mechanical, electrical and other changes may be made without departing from the scope of the embodiments. The following detailed description therefore is not to be taken in a limiting sense.

Various embodiments provide an anode cooling system for a rotating anode-type X-ray tube for use especially in medical imaging. However, the embodiments are not limited and may be implemented in connection with other systems such as, for example, industrial imaging systems, security scanners, etc.

Figure 1:
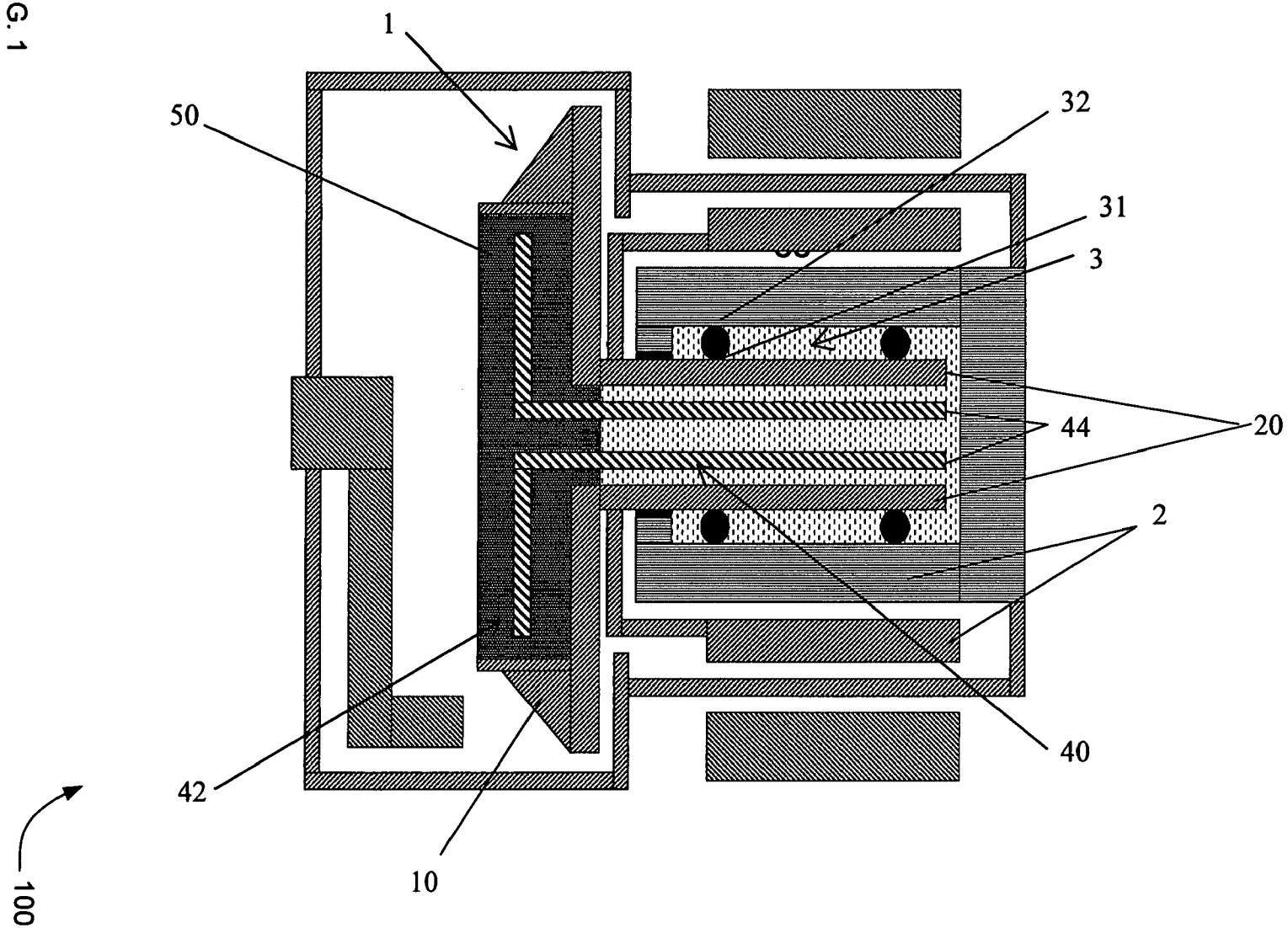
FIG. 1 shows a cross-sectional view of an anode assembly configured having a cooling system according to one embodiment.

FIG. 1 shows a cross-sectional view of an anode assembly configured having a cooling system according to one embodiment. Accordingly, the assembly includes an anode block 1 attached to a rotor housing 2. The anode block 1 includes a disc shaped anode 10 and a spindle 20 extending axially from the anode 10. The rotor housing 2 accommodates a bearing 3 for the anode 10. The bearing 3 includes an inner race 31 rigidly coupled to the spindle 20 and an outer race 32 rigidly coupled to the rotor housing 2 for rotatably supporting the anode 10. A heat pipe arrangement 40 is configured in combination with the anode block 1 and the rotor housing 2.

Figure 2:
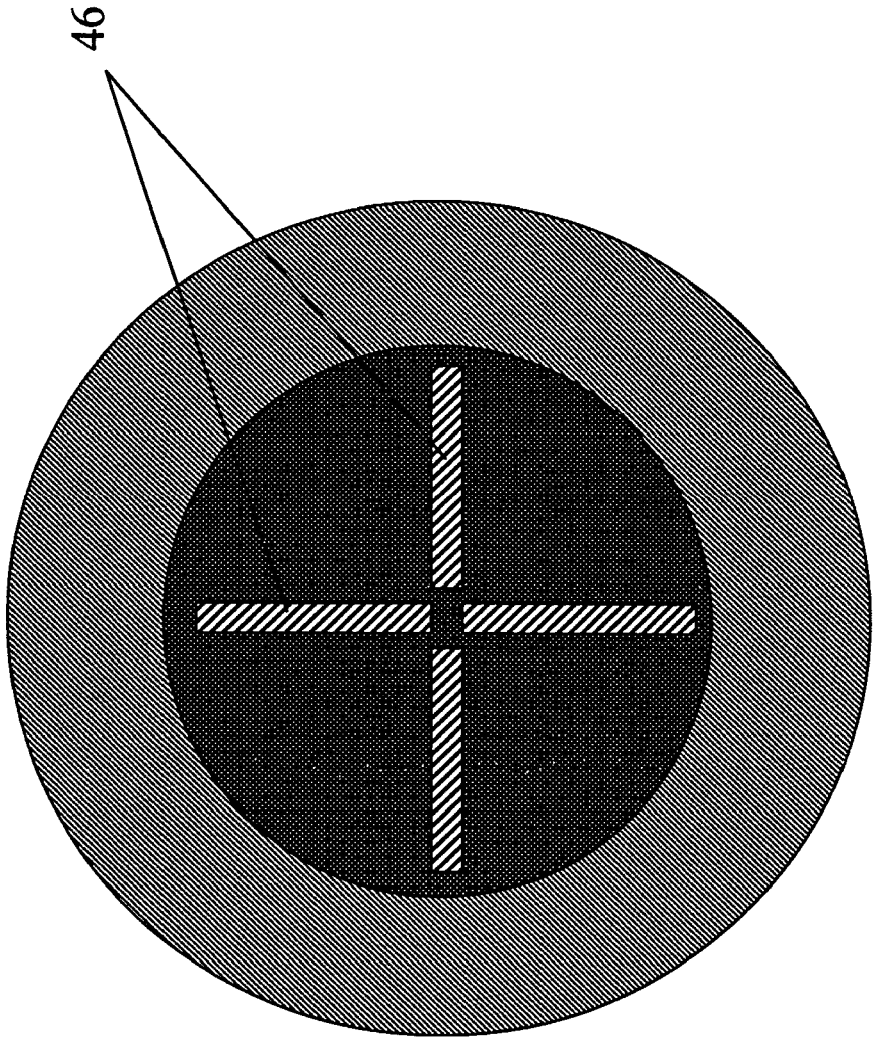
FIG. 2 shows a cross-sectional view of the arrangement of heat pipes in opposite fashion according to some embodiment.

In one embodiment, the heat pipe arrangement 40 includes an evaporator part 42 coupled to the anode 10 and a condenser part 44 coupled to the bearing 3. A plurality of heat pipes 46 (see FIG. 2) is configured in-between the evaporator part 42 and the condenser part 44. The heat pipes 46 are arranged in mutually opposing fashion (see FIG. 2) such that the resultant dynamic force on the heat pipe arrangement 40 is substantially zero.

In one example, at least four heat pipes 46 (see FIG. 2) are arranged in mutually opposing fashion such that dynamic forces of each heat pipe cancel out with the oppositely arranged heat pipe. It should be noted that in this configuration, the vector summation of the total dynamic imbalance between the adjacently arranged heat pipes 46 is substantially less than the dynamic imbalance of each heat pipe. Thus, the resultant dynamic force and hence the dynamic imbalance on the heat pipes is substantially zero.

It should be noted that the arrangement of the heat pipes 46 in mutually opposing configuration not only cancels out the unbalanced forces, but also the use of lithium or lithium alloy, silver or silver alloy as working fluid significantly improves the thermal efficiency of the heat pipes. It should also be noted that lithium, lithium alloys, silver, silver alloys are EHS compatible fluids that can be used in an X-ray tube application.

In an example, (see FIG. 1) the evaporator part 42 includes a block 50 of heat storage or conduction material such as, for example, graphite, copper, carbon foam, etc. attached to the anode (see FIG. 1). In an example, the condenser part 44 includes a liquid metal 52 (see FIG. 3) filled in-between the inner race 31 and the outer race 32 of the bearing 3. An example of the liquid metal 52 includes at least one of a gallium, bismuth, indium, tin and an alloy thereof.

In one example, lithium or lithium alloy, silver or silver alloy is used as working fluid in each heat pipe 46. The heat pipes 46 may be configured as one module (not illustrated in the figures) for mounting in combination with the anode 10 and the bearing 3. In this configuration, one example of module construction includes welding the heat pipes 46 together. Other examples of module construction include binding and brazing the heat pipes 46 together.

In various embodiments described above, during cold start operation of the X-ray tube, a vacuum level of about 10−2 Torr is maintained within each heat pipe 46. The evaporator part 42 transfers the heat from the anode 10 to the working fluid in each heat pipe 46. For example, working fluid such as, lithium or lithium alloy, silver or silver alloy is at a solid state at such vacuum level and starts melting as it takes up the heat transferred from the evaporator part. Lithium or lithium alloy, silver or silver alloy evaporates at around 600 to 2000 deg C. and vapors move towards the condenser part due to pressure difference, wherein the vapors are condensed and the wick on the heat pipe walls transfers the condensed liquid to the evaporator. Liquid metal 52 filled in-between the inner race 31 and the outer race 32 of the bearing 3 acts as the heat sink where the heat pipe 46 rejects the heat. A forced convection coolant heat sink (not shown) may be provided in addition to the liquid metal 52 filled bearing for cooling the heat pipe condenser.

Figure 3:
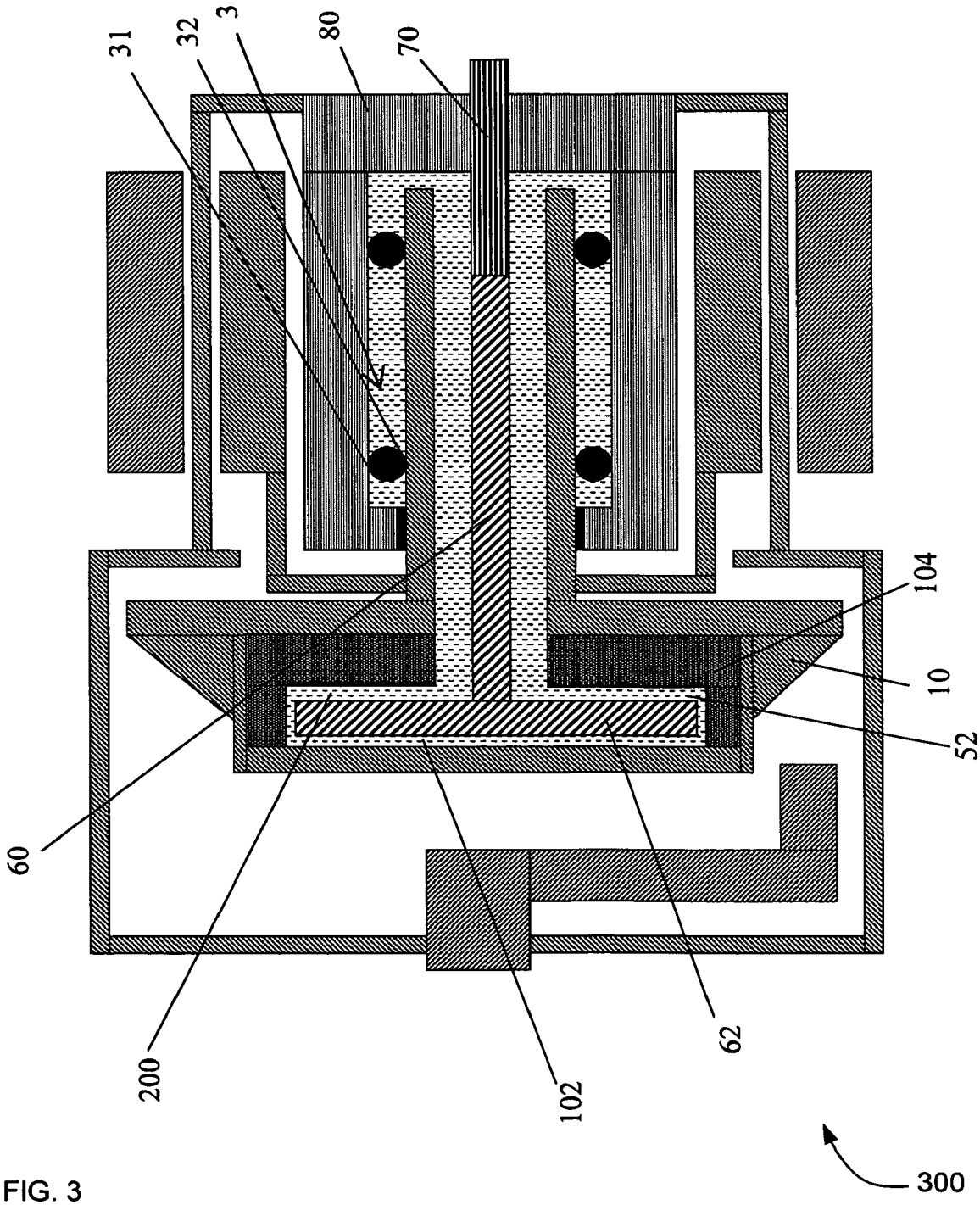
FIG. 3 shows a cross-section of an anode assembly configured with clearance filled with liquid according to some embodiment.

FIG. 3 shows an anode cooling system according to some embodiment, wherein a first heat pipe 60 is configured operating at a predetermined high first temperature range near the anode 10. A second heat pipe 70 is configured operating at a predetermined low second temperature range and coupled to the first heat pipe 60. A heat sink 80 is coupled to the second heat pipe 70

The first heat pipe 60 transfers the heat from the anode 10 to an intermediate location i.e., the second heat pipe 70 away from the anode 10. The second heat pipe 70 transfers the heat from the intermediate location to the heat sink 80. For example, the operating temperature range of the first heat pipe 60 is at least twice more than the second temperature range. In another example, the first temperature range is between 1000 deg C. and 2000 deg C., and the second temperature range is about 300 deg C. to 45 deg C.

In an example, the working fluid for the first heat pipe 60 is selected at least one from among lithium, lithium alloy, silver, and silver alloy. The working fluid for the second heat pipe 70 is at least one of water, Dowtherm Fluids™ etc. The heat sink 80 includes forced convection cooling with oil, water, FC75™, FC77™, etc as working fluid.

FIG. 3 shows some embodiment of anode, wherein the anode 10 comprises a cavity 102. A heat storage or conduction material 104 such as, for example, graphite, copper, carbon foam, etc is disposed in the cavity 102. A plurality of headers 62 extending from the first heat pipe 60 is arranged within the cavity 102. The anode bearing 3 includes an inner race 31 and an outer race 32, wherein a liquid metal such as gallium, bismuth, indium, tin or an alloy thereof is filled in-between the inner race and the outer race.

Figure 4:
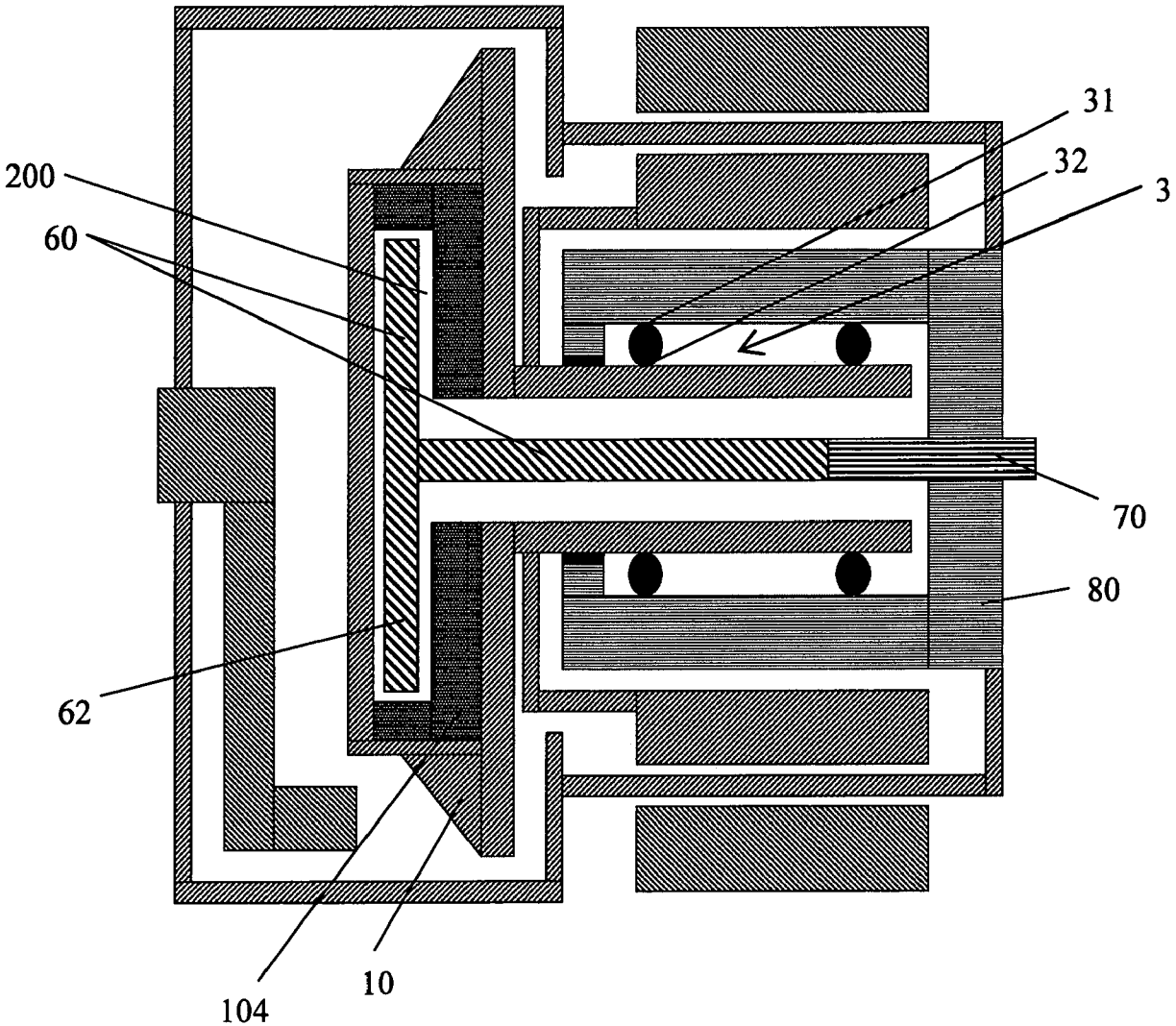
FIG. 4 shows a cross-sectional view of an anode assembly configured with a clearance according to some embodiment.

FIG. 4 shows an example wherein, a clearance 200 is provided in-between the headers 62 and the heat storage or conduction material 104. In this configuration, heat is transferred from the anode 10 to the heat pipe header 62 by radiation. In another example, (see FIG. 3) a liquid metal 52 such as, for example, gallium, bismuth, indium or an alloy thereof is filled in the clearance 200. This arrangement facilitates combined heat conduction and convection from the anode 10 to the headers 62. From the headers 62, the first heat pipe 60 transfers the heat to the second heat pipe 70 in the bearing 3 region. The second heat pipe 70 transfers heat from the bearing 3 to the heat sink 80.

In an example, the first heat pipe 60 and the second heat pipe 70 are fixedly mounted to the outer race 32 of the bearing 3. This can be achieved by welding or brazing the first heat pipe 60 and the second heat pipe 70 and brazing or welding the second heat pipe 70 to the bearing outer race 32 or heat sink 80. The first heat pipe 60 and the second heat pipe 70 may be constructed as one module for insertion on to an existing X-ray tube (not shown).

It should be noted that the anode cooling system according to some embodiments provides improved thermal efficiency by having the heat transferred to the anode bearing 3 before the heat is transferred to the heat sink 80. The problems associated with rotation balance are completely eliminated as the first heat pipe 60 and the second heat pipe 70 are fixedly mounted to the outer race 32 of the anode bearing 3.

Thus, some embodiments provide an anode cooling system for an X-ray tube. Some embodiments provide an X-ray tube.

While the anode cooling system has been described with various specific embodiments, it will be obvious for a person skilled in the art to practice the invention with modifications. However, all such modifications are deemed to be within the scope of the claims.

What is claimed is:

1. An anode cooling system for a rotating-anode type X-ray tube, comprising:

(i) a heat pipe arrangement comprising an evaporator part and a condenser part;

(ii) the evaporator part coupled to an anode;

(iii) the condenser part coupled to a bearing of the anode; and (iv) a plurality of heat pipes configured in-between the evaporator part and the condenser part, wherein the heat pipes are arranged in mutually opposing configuration, such that the resultant dynamic force on the heat pipes is substantially zero.

2. An anode cooling system according to claim 1 further comprising lithium or lithium alloy configured as working fluid in the heat pipes.

3. An anode cooling system according to claim 1 further comprising a heat storage material filled in the evaporator part.

4. An anode cooling system according to claim 3 further comprising an inner race and an outer race in the bearing, wherein a liquid metal is filled in-between the inner race and the outer race.

5. An anode cooling system according to claim 4 wherein the liquid metal is at least one of gallium, bismuth, indium, tin and an alloy thereof.

6. An anode cooling system according to claim 5 further comprising at least four heat pipes in the heat pipe anangement.

7. An anode cooling system according to claim 1 further comprising the heat pipes having configured with a diameter predetermined to have substantially zero dynamic imbalance.

8. An anode cooling system for an X-ray tube, comprising:

(i) a first heat pipe configured for operating at a predetermined high first temperature range near an anode;

(ii) a second heat pipe configured for operating at a predetermined low second temperature range coupled to the first heat pipe;

(iii) a heat sink coupled to the second heat pipe; and (iv) means for transferring heat from the target to a heat pipe evaporator header by convection.

9. An anode cooling system according to claim 8 further comprising the first temperature range set at least twice more than the second temperature range.

10. An anode cooling system according to claim 8 further comprising at least one of lithium, lithium alloy, silver and silver alloy configured as working fluid in the first heat pipe.

11. An anode cooling system according to claim 8 further comprising at least one of water and Dowtherm fluids configured as working fluid in the second heat pipe.

12. An anode cooling system according to claim 8 further comprising a cavity configured within the anode, wherein a plurality of headers are provided within the cavity.

13. An anode cooling system according to claim 12 further comprising a heat storage material filled in the cavity, wherein the headers are configured maintaining a clearance against the heat storage material.

14. An anode cooling system according to claim 13 further comprising a liquid metal filled in-between the heat pipe and the anode, wherein the liquid metal includes at least one from among gallium, indium, tin, bismuth and an alloy thereof.

15. An anode cooling system according to claim 8 further comprising an anode bearing comprising an inner race and an outer race, wherein a liquid metal or a liquid alloy is filled in-between the inner race and the outer race, wherein the liquid metal includes at least one selected from among gallium, indium, tin, bismuth and an alloy thereof.

16. An anode cooling system according to claim 8 further comprising at least one of the first heat pipe and the second heat pipe mounted fixedly to the anode bearing.

17. An anode cooling system according to claim 8 wherein a non-wetting corrosion resistant layer is provided on surfaces in contact with the liquid metal.

18. An anode cooling system according to claim 8 further comprising a means for transferring heat from the target to a heat pipe evaporator header by radiation.

19. An X-ray tube, comprising:

(i) an anode target;

(ii) a heat sink;

(iii) a means for transferring heat from the anode target to an intermediate location away from the anode;

(iv) a means for transferring heat from the intermediate location to the heat sink; and (v) means for transferring heat from the anode target to a heat pipe evaporator header by radiation or convection.

* * * * *